United States Patent [19]

Galle, Jr.

[11] Patent Number: 4,528,738

[45] Date of Patent: Jul. 16, 1985

[54] DUAL RING CASING HANGER

[75] Inventor: Edward M. Galle, Jr., Houston, Tex.

[73] Assignee: Armco Inc., Middletown, Ohio

[21] Appl. No.: 572,916

[22] Filed: Jan. 23, 1984

Related U.S. Application Data

[62] Division of Ser. No. 316,397, Oct. 29, 1981, Pat. No. 4,460,042.

[51] Int. Cl.[3] ..... B23P 17/00; F16L 35/00; E21B 10/10

[52] U.S. Cl. ..... 29/416; 285/3; 285/141

[58] Field of Search ..... 235/3, 141, 18; 166/208, 86, 88, 40, 210, 382, 348; 29/416

[56] References Cited

U.S. PATENT DOCUMENTS

| | | | |
|---|---|---|---|
| 3,420,308 | 1/1969 | Putch | 166/208 |
| 3,472,530 | 10/1969 | Fowler | 285/3 |
| 3,592,489 | 7/1971 | Baugh | 285/18 |
| 3,893,717 | 7/1975 | Nelson | 285/3 |
| 3,918,747 | 11/1975 | Putch | 285/4 |
| 4,073,511 | 2/1978 | Haas et al. | 285/3 |
| 4,167,970 | 9/1979 | Cowan | 166/208 |
| 4,181,331 | 1/1980 | Cowan | 285/141 |
| 4,232,889 | 11/1980 | Putch | 285/141 |
| 4,295,665 | 10/1981 | Pierce | 285/141 X |
| 4,319,773 | 3/1982 | Lawson | 285/137 A |

*Primary Examiner*—Mark Rosenbaum
*Assistant Examiner*—Steven Nichols
*Attorney, Agent, or Firm*—Roylance, Abrams, Berdo & Goodman

[57] ABSTRACT

A hanger apparatus for suspending an upright inner pipe from an outer pipe including a pair of load-bearing rings interposed between the two pipes. The inner and outer pipes have opposed frustoconical load-bearing shoulders receiving the rings therebetween. In one embodiment, both rings engage the inner and outer pipes, with an upper ring being driven outwardly into a locking position by a lower ring. In this case, the upper ring is split while the lower ring is solid. In a second embodiment, an outer ring engages both the inner and outer pipes while an inner ring is nested into the outer ring and engages the inner pipe. In this second embodiment, both rings are split.

4 Claims, 8 Drawing Figures

DUAL RING CASING HANGER

This is a division of application Ser. No. 316,397, filed Oct. 29, 1981, now U.S. Pat. No. 4,460,042.

FIELD OF THE INVENTION

The invention relates to a hanger apparatus for suspending an upright inner pipe from an outer pipe. The inner pipe can be a casing hanger body and the outer pipe a wellhead housing used in the subsea production of oil. The apparatus includes a pair of load-bearing rings interposed between the inner and outer pipes.

BACKGROUND OF THE INVENTION

It has long been a common practice in the well art to suspend an inner pipe, typically a casing string, concentrically within an outer pipe, typically an outer casing string or wellhead housing, by means of a hanger comprising a hanger member connected to the inner pipe and having a downwardly directed shoulder which engages an upwardly directed shoulder on the outer member as the inner pipe is run in. As the art developed, it became necessary to minimize the annular space between the inner and outer pipes and prior art workers have developed hangers employing a retractable hanger device carried by a mandrel on the inner pipe and capable of expanding into engagement with an outer hanger member when, as the inner pipe is run in, the mandrel reaches the outer hanger member. Such prior art hanger devices are disclosed in the following U.S. Pat. Nos.: 3,420,308 to Putch; 3,472,530 to Fowler; 3,592,489 to Baugh et al; 3,893,717 to Nelson; 3,918,747 to Putch; 4,073,511 to Haas et al; 4,167,970 and 4,181,331 to Cowan; and 4,232,889 to Putch.

However, as the search for oil in the offshore areas of the world increases, the depth of the offshore wells also increases. To withstand the pressures experienced at great depths, the apparatus used is larger and heavier. Unfortunately, many of the prior art hanger apparatus are not suitable for suspending the heavier pipes since they usually utilize only a single member to bear the load between the inner and outer pipes. Moreover, many of these prior art devices are complicated to manufacture and use and are not readily adapted to the increased demands of the heavier offshore equipment.

SUMMARY OF THE INVENTION

Accordingly, it is a primary object of the present invention to provide a hanger apparatus for suspending pipes which is effective in sustaining extremely heavy loads between the pipes.

Another object of the invention is to provide such a hanger apparatus that is relatively simple to manufacture and use.

Another object of the invention is to provide such a hanger apparatus with a pair of load-bearing rings for supporting an inner pipe inside an outer pipe.

The foregoing objects are basically attained by providing a hanger apparatus for suspending an upright inner pipe from an outer pipe, the combination comprising an upwardly facing load-bearing shoulder on the outer pipe; first and second downwardly facing load-bearing shoulders on the inner pipe; an expandable outer split locking ring having a downwardly facing load-bearing shoulder engageable with the upwardly facing load-bearing shoulder on the outer pipe and an upwardly facing load-bearing shoulder engageable with the first downwardly facing load-bearing shoulder on the inner pipe; and ring means, shearably coupled to the inner pipe and engaging the outer split locking ring, for releasably coupling the outer split locking ring to the inner pipe below the first downwardly facing load-bearing shoulder on the inner pipe, the ring means having an upwardly facing load-bearing shoulder engageable with the second downwardly facing load-bearing shoulder on the inner pipe.

Other objects, advantages and salient features of the present invention will become apparent from the following detailed description, which, taken in conjunction with the annexed drawings, discloses preferred embodiments of the invention.

DRAWINGS

Referring now to the drawings which form a part of this original disclosure:

DETAILED DESCRIPTION OF THE INVENTION OF FIGS. 1–4

Figure 4:
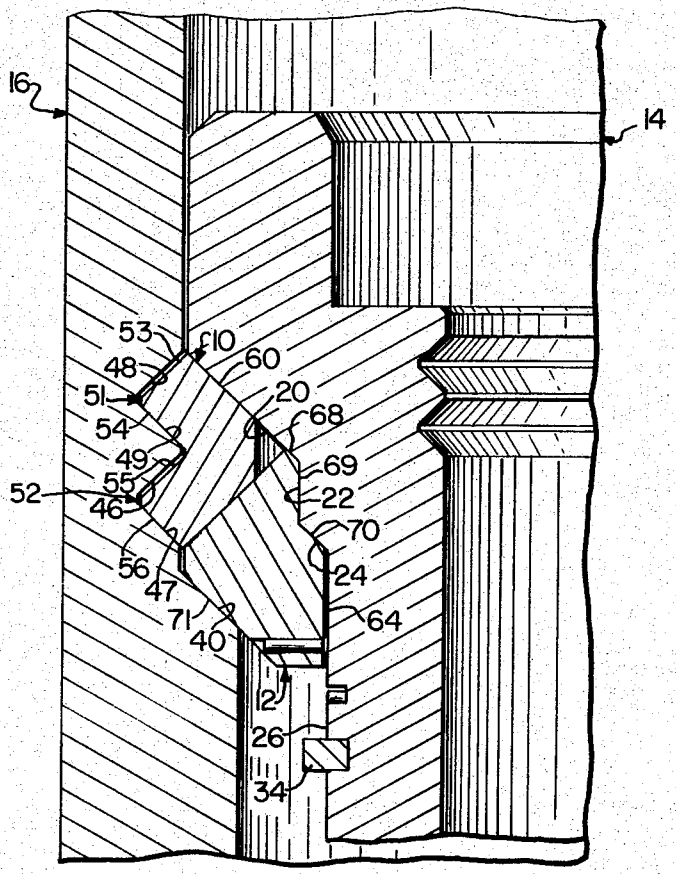
FIG. 4 is a view similar to that shown in FIG. 3, except that the lower ring has driven the upper ring into a load-bearing position.

Referring now to FIGS. 1–4, the first embodiment of the invention is shown comprising an expandable upper split locking ring 10, and a lower setting ring 12 interposed between an inner pipe 14 and an outer pipe 16. Both of these rings are load-bearing, as shown in FIG. 4, where the inner pipe is suspended in the outer pipe.

The inner pipe 14 can be a casing hanger body and has an outer cylindrical surface 18 which extends into an outwardly facing, downwardly and inwardly tapered frustoconical surface 20. This surface 20 forms a load-bearing shoulder and tapers at 45 degrees. This surface 20 exends into an outwardly facing substantially cylindrical surface 22 which extends into an outwardly facing, downwardly and inwardly tapering frustoconical surface 24, which tapers at about 45 degrees. Both surfaces 22 and 24 are also load-bearing shoulders. Surface 24 extends into a substantially cylindrical surface 26 having a pair of annular grooves 28 and 30 extending inwardly thereof. Each of these grooves has a substantially rectangular cross-section, groove 30 being below groove 28. Groove 28 receives a plurality of shear pins 32 therein which are also received in setting ring 12. Preferably six of these pins are utilized. Received in groove 30 is a split ring 34 which extends outwardly from cylindrical surface 26. This split ring also has a rectangular cross-section.

The outer pipe 16, which can be a wellhead housing, has an upper cylindrical surface 36 slightly larger than cylindrical surface 18 on the inner pipe 14, a lower cylindrical surface 38 having a diameter less than cylindrical surface 18 but greater than cylindrical surface 26 of the inner pipe 14, and an inwardly facing, downwardly and inwardly tapered frustoconical surface 40 interposed between upper and lower cylindrical surfaces 36 and 38. This surface 40 tapers at about 45 degrees and is a load-bearing shoulder. Above frustoconical surface 40 is a short cylindrical surface 42 and between cylindrical surfaces 42 and 36 are a pair of grooves 44 and 45. Groove 44 is defined by an upper upwardly and inwardly tapered frustoconical surface 46 and by a lower downwardly and inwardly tapering frustoconical surface 47, this surface 47 being a load-bearing shoulder. Similarly, groove 45 is defined by an upper upwardly and inwardly tapering frustoconical surface 48 and a lower downwardly and inwardly tapered frustoconical surface 49, this surface 49 being a load-bearing shoulder.

Figure 1:
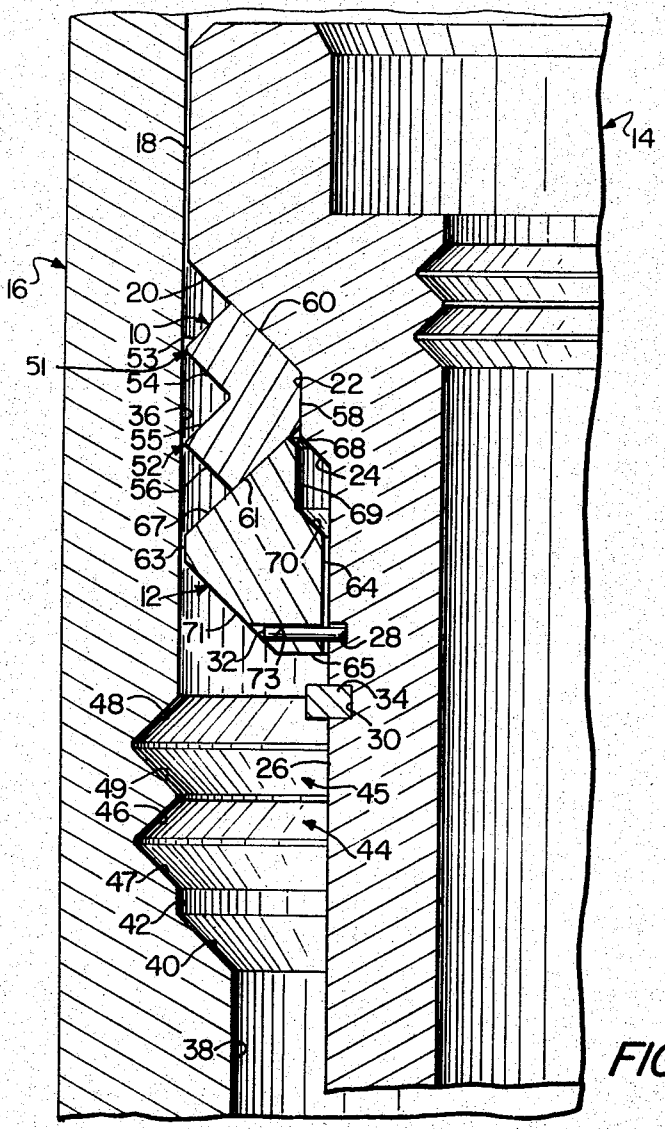
FIG. 1 is a fragmentary longitudinal cross-sectional view illustrating a hanger apparatus according to one embodiment of the invention showing a pair of locking rings coupled to the inner pipe which is being moved downwardly through the outer pipe.

The upper split locking ring 10, which is in its normal rest position shown in FIG. 1, has two outwardly facing ribs 51 and 52, which are receivable in grooves 45 and 44 in the outer pipe 16, as seen in FIG. 4. Rib 51 is defined by an upper upwardly and inwardly tapering frustoconical surface 53 and a downwardly and inwardly tapered frustoconical surface 54. Similarly, rib 52 is defined by an upper upwardly and inwardly tapering frustoconical surface 55 and a lower downwardly and inwardly tapered frustoconical surface 56. Surfaces 54 and 56 are load-bearing shoulders, with surfaces 54 and 55 defining a groove for receiving a rib defined by frustoconical surfaces 46 and 49 on the outer pipe. On the side of split locking ring 10 opposite ribs 51 and 52 is an inner cylindrical surface 58. Between cylindrical surface 58 and frustoconical surface 53 is a downwardly and inwardly tapering frustoconical surface 60, which is a load-bearing shoulder. Similarly, between cylindrical surface 58 and frustoconical surface 56 is a upwardly and inwardly tapering frustoconical surface 61. This surface 61 is in slideable engagement with setting ring 12.

As seen in FIG. 1, all of the frustoconical surfaces forming the split locking ring 10 are substantially at 45 degrees with frustoconical surface 60 on the ring being in slideable engagement with frustoconical surface 20 on the inner pipe. In the position shown in FIG. 1, cylindrical surface 58 on the ring 10 is in engagement with cylindrical surface 22 on the inner pipe.

The lower setting ring 12 has an outwardly facing cylindrical surface 63, an inwardly facing cylindrical surface 64 and a downwardly facing annular surface 65. Extending upwardly and inwardly from the outer cylindrical surface 63 is a tapering frustoconical surface 67, which extends into a downwardly and inwardly tapering frustoconical surface 68. This surface 68 extends into a cylindrical surface 69, which in turn extends into a downwardly and inwardly tapering frustoconical surface 70. This surface 70 extends into the inner cylindrical surface 64. As seen in FIG. 1, all of the frustoconical surfaces in the setting ring 12 are at substantially 45 degrees, with surfaces 68 and 70 being load-bearing shoulders engaging surfaces 20 and 24 on the inner pipe 14 as seen in FIG. 4. In addition, frustoconical surface 71 extends downwardly and inwardly between cylindrical surface 63 and annular surface 65 at substantially 45 degrees. This surface 71 is a load-bearing shoulder intended to engage frustoconical surface 40 on the outer pipe as seen in FIG. 4. As seen in FIG. 1, frustoconical surface 67 on the setting ring is in slideable engagement with frustoconical surface 61 on the split locking ring 10.

As seen in FIG. 1, cylindrical surface 64 has a diameter slightly larger than cylindrical surface 26 on the inner pipe and cylindrical surface 63 on the setting ring 12 has a diameter slightly less than the inner diameter of cylindrical surface 36 on the outer pipe, and substantially the same as cylindrical surface 18.

Passing completely through the setting ring 12 between frustoconical surface 71 and cylindrical surface 64 are a plurality of horizontally-oriented cylindrical bores 73 receiving the shear pins 32 therein.

OPERATION OF THE EMBODIMENT OF FIGS. 1–4

As seen in FIG. 1, the inner pipe 14 is being run in through the hollow part of the outer pipe 16 with the split locking ring 10 and setting ring 12 releasably coupled to the inner pipe by means of the shear pins 32. In this configuration, the setting ring 12 is directly coupled via the shear pins to the inner pipe 14 and supports the split locking ring 10 so that the lower frustoconical surface 61 on the split locking ring 10 engages the upper frustoconical surface 67 on the setting ring.

Figure 2:
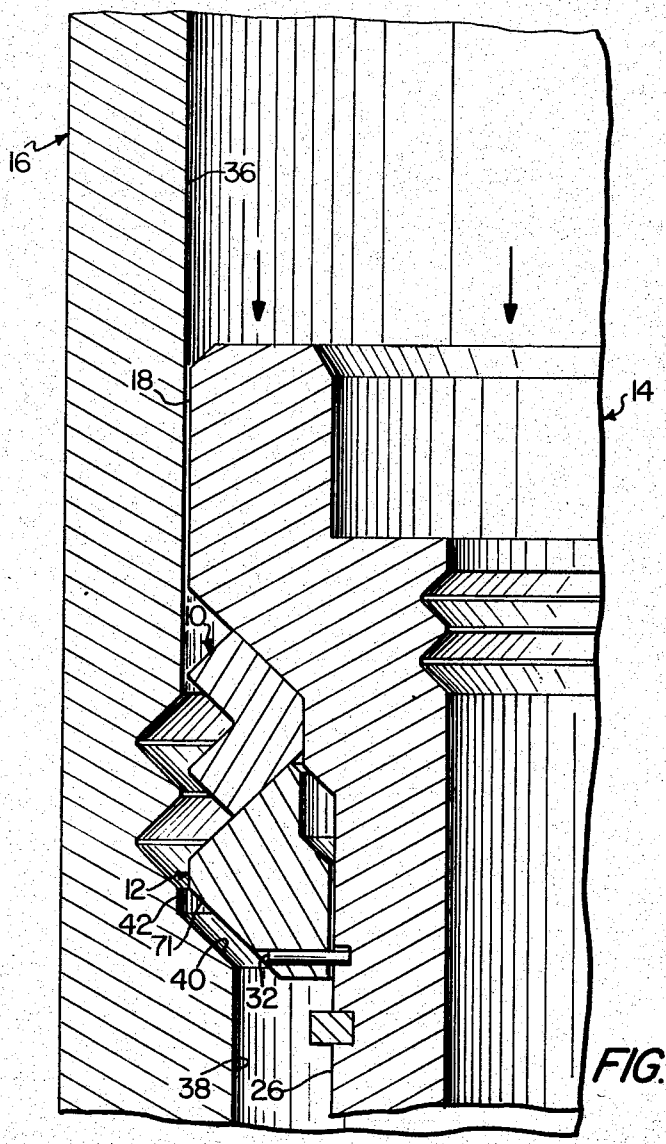
FIG. 2 is a view similar to that shown in FIG. 1, except that the inner ring is about to be landed on an inwardly and upwardly extending shoulder on the outer pipe.

As shown in FIG. 2, the inner pipe 14 has been lowered relative to the outer pipe 16 so that frustoconical surface 71 on the setting ring is about to contact the upwardly and inwardly facing frustoconical surface 40 on the outer pipe 16.

Figure 3:
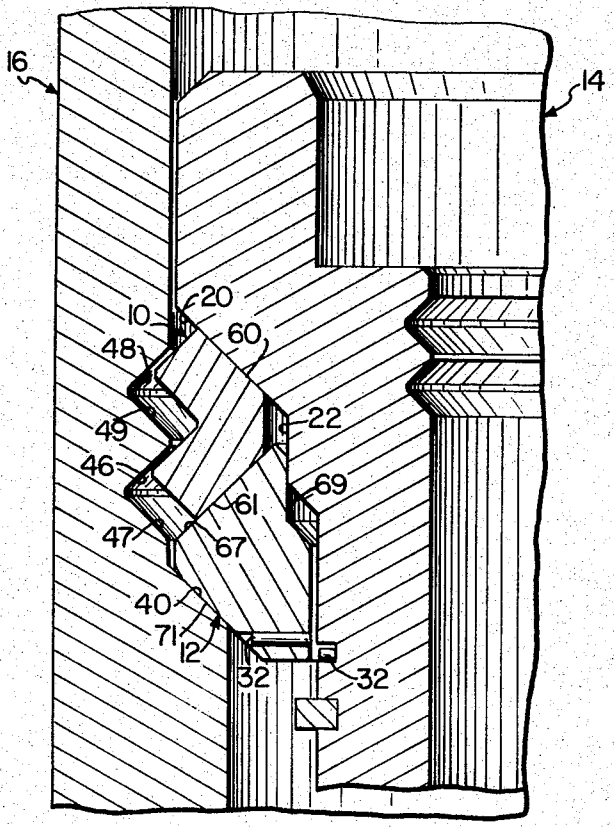
FIG. 3 is a view similar to that shown in FIG. 2, except that the lower locking ring has been landed on the shoulder in the outer pipe and continued downward movement of the inner pipe causes a breaking of the shear pins holding the lower ring to the inner pipe and wherein the lower ring is driving the upper ring outwardly.

In FIG. 3, these surfaces 71 and 40 have contacted with the inner pipe 14 having continued to move downwardly, thereby breaking the shear pins 32 and causing the split locking ring 10 to be biased outwardly towards the grooves in the outer pipe formed by frustoconical surfaces 46–49. This outward bias is caused by the downward movement of the inner pipe in combination with the slideable engagement of frustoconical surface 20 on the pipe and frustoconical surface 60 on the locking ring 10 in addition to the sliding contact of the frustoconical surface 61 on the locking ring 10 and the frustoconical surface 67 on the setting ring 12. Of course, the setting ring 12 cannot move downwardly since its frustoconical surface 71 is in engagement with the frustoconical surface 40 on the outer pipe.

In FIG. 4, the continued downward movement of the inner pipe 14 is halted by a full outward biasing of the locking ring 10 and complete engagement of the inner pipe with both the locking ring 10 and the setting ring 12. In particular, the frustoconical surface 20 and frustoconical surface 24 on the inner pipe have come into a load-bearing engagement with the frustoconical surface 60 on the split locking ring 10 and the frustoconical surface 68 and frustoconical surface 70 of the setting ring 12. In addition, the setting ring 12 has its frustoconical surface 71 in load-bearing engagement with frustoconical surface 40 of the outer pipe and the two frustoconical surfaces 54 and 56 of the split locking ring 10 are in load-bearing engagement with the frustoconical surfaces 49 and 47 of the outer pipe. In this configuration shown in FIG. 4, the ribs 51 and 52 of the locking ring 10 are fully received in the pair of grooves defined by the frustoconical surfaces 46–49 in the outer pipe.

To retrieve the inner pipe 14 upwardly through the outer pipe 16, all that is required is upward movement on the inner pipe which brings ring 34 into engagement with setting ring 12, thereby freeing the setting ring and locking ring from the engagement with the outer pipe 16.

EMBODIMENT OF FIGS. 5–8

Referring to FIGS. 5–8, a second embodiment of the invention is illustrated, including an outer split locking ring 75 and an inner split locking ring 76 to be interposed between the inner pipe 77 and the outer pipe 78. In this embodiment, the inner locking ring is nested into the outer locking ring and in the suspended position the inner locking ring is interposed between the inner pipe and the outer locking ring, the outer locking ring being interposed between the inner and outer pipes.

The inner pipe 77 has an outer cylindrical surface 80 interrupted by a recess 81 in which both the inner and outer locking rings are located. At the top of the recess 81 is an outwardly facing downwardly and inwardly tapering frustoconical surface 83 which extends into a cylindrical surface 84 which in turn extends into a downwardly and inwardly tapering frustoconical surface 85. This surface 85 extends into a cylindrical surface 86 which in turn extends into a downwardly and inwardly tapering frustoconical surface 87. This surface 87 extends into a cylindrical surface 88 which extends into an upwardly facing annular surface 89 at the bottom of recess 81. Each of these frustoconical surfaces tapers at substantially 45 degrees. Extending radially inward of cylindrical surface 88 is a horizontally-oriented annular groove 90 having a substantially rectangular cross-section.

The inner locking ring 76 has an outer cylindrical surface 91, an inner cylindrical surface 92, an upper annular surface 93, a lower annular surface 94 and a downwardly and inwardly tapering frustoconical surface 95 tapering at about 45 degrees between annular surface 93 and cylindrical surface 92. A plurality of throughbores 96 extend horizontally through ring 76 from cylindrical surface 91 to cylindrical surface 92 and receive a plurality of shear pins 97 therein, the ends of these pins being received in groove 90 in the inner pipe 77.

The outer locking ring 75 has three ribs 100, 101 and 102 formed on the outer surface thereof, has a downwardly facing annular surface 104 at the bottom and has an inner surface comprised of a cylindrical surface 106 extending upwardly from annular surface 104 into a downwardly and inwardly tapering frustoconical surface 108 at the top. Cylindrical surface 106 is interrupted by an inwardly facing groove 110 having a rectangular cross-section and receiving the inner ring 76 therein.

Figure 6:
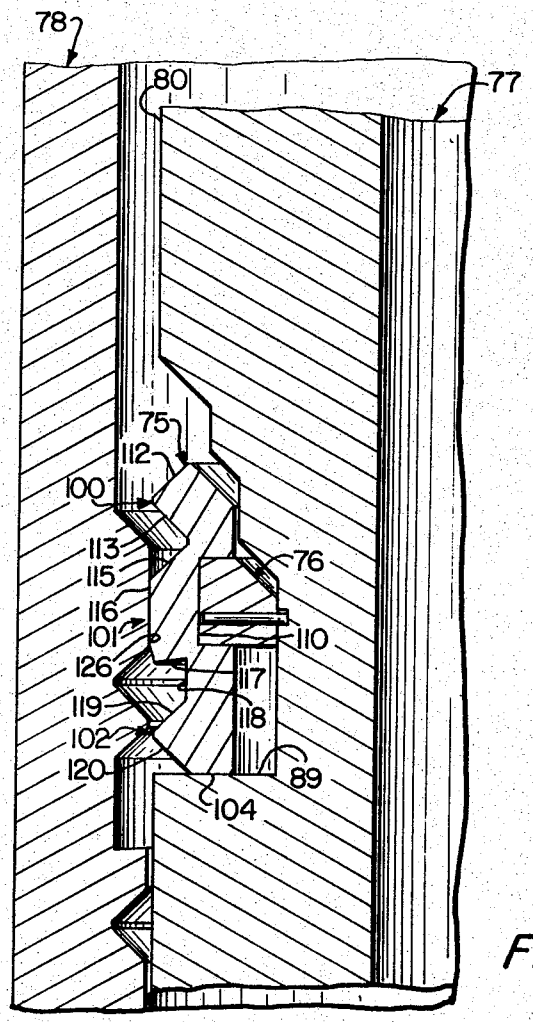
FIG. 6 is a view similar to that shown in FIG. 5, except that the inner pipe has been run down the outer pipe to a position in which an inwardly and upwardly facing biasing shoulder on the outer pipe has biased the outer ring radially inwardly.

As seen in FIG. 6, rib 100 on the outer locking ring 75 is comprised of an upwardly and inwardly tapering frustoconical surface 112 and a downwardly and inwardly tapering frustoconical surface 113, both tapering at substantially 45 degrees. Rib 101 comprises an upwardly and inwardly tapering frustoconical surface 115, a cylindrical surface 116 and an upwardly and inwardly back-tapering frustoconical surface 117. Rib 102 is comprised of an upwardly and inwardly tapering frustoconical surface 119 and a downwardly and inwardly tapering frustoconical surface 120. As seen in FIG. 6, each of these frustoconical surfaces, except for surface 117, are at an angle of substantially 45 degrees, surface 117 being at an angle of about 5–7 degrees. These surfaces forming ribs 100, 101 and 102 are continuous such that surface 113 extends into surface 115, surface 117 extends into a cylindrical surface 118 which in turn extends into surface 119 and surface 120 extends into the annular surface 104 at the bottom of ring 75.

Figure 5:
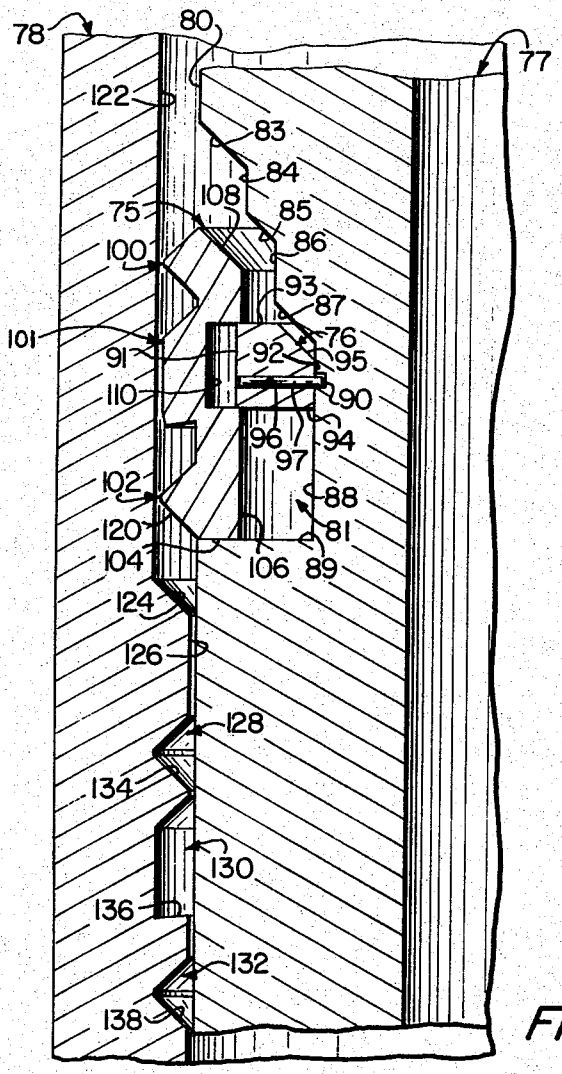
FIG. 5 is a fragmentary longitudinal cross-sectional view illustrating a hanger apparatus according to a second embodiment of the invention in which an inner ring nests in an outer ring, both rings being split.

As seen in FIG. 5, the outer pipe 78 has a cylindrical surface 122 which extends into an upwardly facing downwardly and inwardly tapering frustoconical surface 124 which then extends into a cylindrical surface 126. In its normally expanded configuration shown in FIG. 5, the outer diameter of the outer ring 75 is slightly less than the inner diameter of cylindrical surface 122 in the outer pipe 78, while the outer diameter 80 of the inner pipe 77 is slightly less than the inner diameter of cylindrical surface 126 of the outer pipe.

Figure 8:
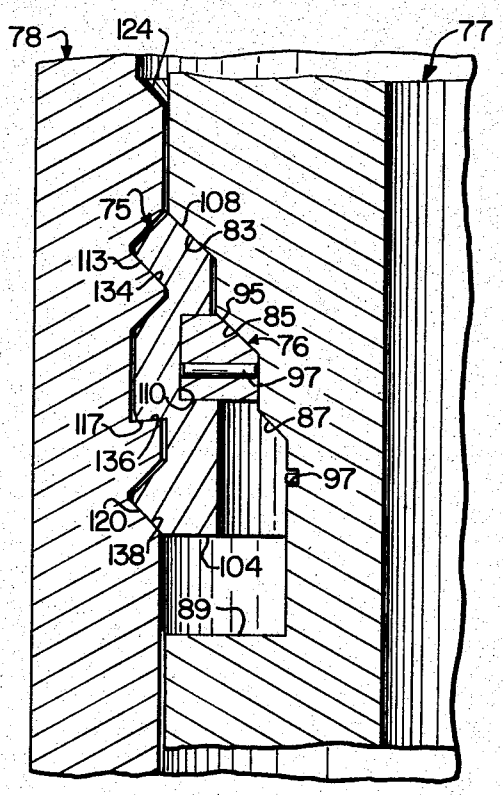
FIG. 8 is a view similar to that shown in FIG. 7, except that the inner pipe has moved downwardly and engages both the inner and outer rings in a load-bearing configuration.
Figure 7:
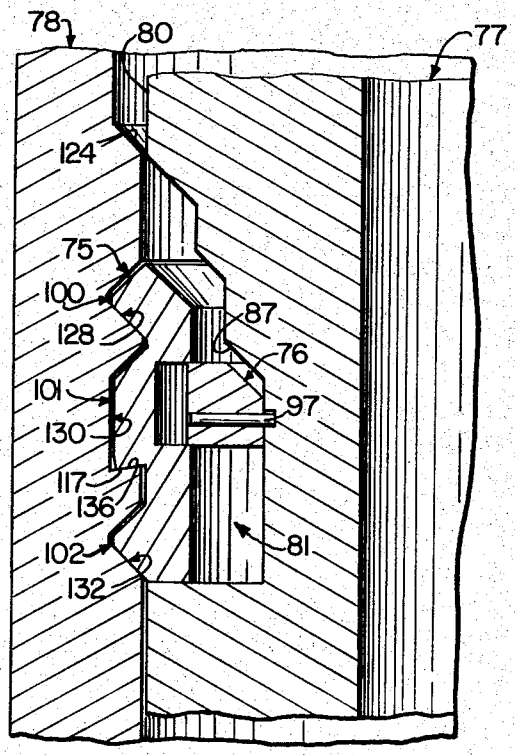
FIG. 7 is a view similar to that shown in FIG. 6, except that the inner pipe has been run down the outer pipe a further distance wherein the outer ring has engaged grooves in the outer pipe.

As seen in FIG. 5, the cylindrical surface 126 is interrupted by a series of grooves 128, 130 and 132 corresponding in configuration and spacing to ribs 100, 101 and 102 in outer ring 75. These grooves 128, 130 and 132 have respectively load-bearing upwardly and inwardly facing frustoconical shoulders 134, 136 and 138 at the bottom thereof. As seen in FIGS. 7 and 8, the locking ring 75 ultimately will be received in the outer pipe 78 such that the ribs in the ring are received in the grooves in the pipe.

OPERATION OF THE EMBODIMENT OF FIGS. 5–8

In operation, the inner pipe 77 is run through the outer pipe 78 with the inner and outer rings 75 and 76 releasably coupled to the inner pipe as shown in FIG. 5. In this configuration, the inner ring 76 is directly shear-pinned to the inner pipe and is partially received in groove 110 in the outer locking ring 75 which has its bottom surface 104 resting on surface 89 at the bottom of recess 81 in the inner pipe.

As the inner pipe 77 is lowered through the outer pipe, frustoconical surface 120 at the bottom of the outer ring comes into sliding engagement with the inwardly facing frustoconical surface 124 on the outer pipe. This contact biases the outer ring 75 inwardly as shown in FIG. 6 so that the outer ring slides more fully onto the inner ring. Because of the configuration of the grooves in the outer pipe and the ribs in the outer ring, the ring can slide downwardly past these various grooves until the grooves and ribs match as shown in FIG. 7.

When this happens, the outer ring 75 expands radially outwardly and the ribs 100, 101 and 102 thereon are received in the grooves 128, 130 and 132 in the outer pipe.

Because of the interconnection of frustoconical surface 117 on ring 75 and frustoconical surface 136 on the outer pipe, once these ribs in the ring and grooves in the pipe are engaged, further downward movement of the ring is prevented. Thus, as the inner pipe continues to move downwardly, shear pins 97 break and the inner ring 76 is biased outwardly by frustoconical surface 87 on the inner pipe.

As shown in FIG. 8, continued downward movement of the inner pipe causes the frustoconical surfaces 83 and 85 on the inner pipe to come into a load-bearing engagement with the frustoconical surface 108 on the outer ring 75 and the frustoconical surface 95 on the inner ring 76. Moreover, the downwardly and outwardly facing frustoconical surfaces 113, 117 and 120 on the outer ring 75 come into a load-bearing relationship with the upwardly and inwardly facing frustoconical surfaces 134, 136 and 138 on the outer pipe 78. In this configuration shown in FIG. 8, the vertical and lower horizontal walls of the groove 110 in the outer ring are in a load-bearing relationship with the inner ring 76.

To unlock this suspension of the inner pipe to the outer pipe, the inner pipe is moved upwardly so that annular surface 89 engages annular surface 104 in the outer ring which pushes the ring upwardly and out of the locking configuration.

While various advantageous embodiments have been chosen to illustrate the invention, it will be understood by those skilled in the art that various changes and modifications can be made therein without departing from the scope of the invention as defined in the appended claims.

What is claimed is:

1. A method of suspending an upright inner pipe from an outer pipe comprising the steps of lowering the inner pipe downwardly into the outer pipe to a predetermined position, the inner pipe having a downwardly facing load-bearing shoulder and carrying a locking member and a support member for supporting the locking member, preventing further downwardly movement of the support member at the predetermined position but allowing the inner pipe to continue moving downwardly, and biasing the locking member radially outwardly, during the continuing downward movement, into engagement with an upwardly facing load-bearing shoulder on the outer pipe by sliding the locking member outwardly along the support member and along the inner pipe load-bearing shoulder by such continuing downward movement of the inner pipe, the inner pipe being suspended from the outer pipe by means of a load-bearing relationship extending from the load-bearing shoulder on the inner pipe, through the locking member and to the load-bearing shoulder on the outer pipe, the support member being shearably coupled to the inner pipe, and the step of allowing the inner pipe to continue moving downwardly including breaking the shearable coupling.

2. The method according to claim 1, wherein the support member is annular and has a fixed radius.

3. A method of suspending an upright inner pipe from an outer pipe comprising the steps of lowering the inner pipe downwardly into the outer pipe to a predetermined position, the inner pipe having a downwardly facing load-bearing shoulder and carrying a locking member and a support member for supporting the locking member, preventing further downward movement of the support member at the predetermined position but allowing the inner pipe to continue moving downwardly, and biasing the locking member radially outwardly, during the continuing downward movement, into engagement with an upwardly facing load-bearing shoulder on the outer pipe by sliding the locking member outwardly along the support member and along the inner pipe load-bearing shoulder by such continuing downward movement of the inner pipe, the inner pipe being suspended from the outer pipe by means of a load-bearing relationship extending from the load-bearing shoulder on the inner pipe, through the locking member and to the load-bearing shoulder on the outer pipe, the support member being annular and having a fixed radius.

4. A method according to claim 3, wherein the lowering step is preceded by the step of coupling the support member to the inner pipe via a plurality of pins.

* * * * *